US005560240A

United States Patent [19]

Förster et al.

[11] Patent Number: 5,560,240

[45] Date of Patent: Oct. 1, 1996

[54] APPARATUS AND PROCESS FOR THE TRANSPORT OF EXTRUDED PROFILES

[75] Inventors: Karl Förster, Eupen, Belgium; Bruno Mancini, Bagnolo Mella, Italy

[73] Assignees: Norsk Hydro a.s., Oslo, Norway; Cometal Engineering SRL, Rodingo Saiano, Italy

[21] Appl. No.: 404,766

[22] Filed: Mar. 15, 1995

[30] Foreign Application Priority Data

Mar. 15, 1995 [EP] European Pat. Off. ..... 94200653

[51] Int. Cl.[6] ..... B21C 35/00

[52] U.S. Cl. ..... 72/257; 72/254; 72/263

[58] Field of Search ..... 72/254, 257, 263, 72/426, 242.2; 198/469.1, 470.1, 478.1, 832.1

[56] References Cited

U.S. PATENT DOCUMENTS

| | | | |
|---|---|---|---|
| 3,032,187 | 5/1962 | Hutch | 72/257 |
| 3,462,991 | 8/1969 | Asari | 72/257 |
| 5,031,437 | 7/1991 | Elhaus et al. | 72/257 |
| 5,154,687 | 10/1992 | Jeslis | 198/478.1 |
| 5,335,528 | 8/1994 | Cristiani | 72/263 |

FOREIGN PATENT DOCUMENTS

| | | |
|---|---|---|
| 1452356 | 3/1969 | Germany . |
| 1452350 | 10/1969 | Germany . |
| 4019974 | 1/1992 | Germany . |
| 1018613 | 1/1966 | United Kingdom . |

OTHER PUBLICATIONS

Patent Abstracts of Japan, vol. 9, No. 187 (M–401) 1985 & JP–A–60 054 225 (Kobe Seikosho).

*Primary Examiner*—Daniel C. Crane
*Assistant Examiner*—Ed Tolan
*Attorney, Agent, or Firm*—Wenderoth, Lind & Ponack

[57] ABSTRACT

An apparatus for the extrusion of profiles includes at least two rectilinear transport path for receiving extruded profiles and provided with clamping devices for clasping the leading and trailing ends respectively of respective extruded profiles. The two transport paths are carried by a drum-like rotatable support whereby each transport path can be moved from an extrusion position whereat an extruded profile can be received on the transport path, and a transfer position whereat the profile can be transferred from the transport path to another processing station, and further to the extrusion position.

19 Claims, 5 Drawing Sheets

APPARATUS AND PROCESS FOR THE TRANSPORT OF EXTRUDED PROFILES

BACKGROUND OF THE INVENTION

The invention relates to an apparatus for the transport of extruded profiles and includes at least one rectilinear transport path for receiving an extruded profile, and clamping means for clasping the leading and trailing ends respectively of an extruded profile. Such an apparatus is known from German Patent Application 4.019.974 (DE-A-4.019.974).

In such known apparatus, the profiles after being extruded are moved laterally in a horizontal plane with respect to the extrusion direction, in order to have the profiles cooled and transported to subsequent treatment stations. This type of relative arrangement of the different parts of an extrusion installation requires a large amount of space and does not allow optimal control of the profiles, especially not in high speed processes.

SUMMARY OF THE INVENTION

It is an object of the invention to provide an apparatus for the transport of the extruded profiles wherein such problems are avoided.

This object is achieved in that the apparatus contains at least two transport paths, each transport path being carried by a rotatable drum-like means, whereby each transport path can be moved from an extrusion position, whereat an extruded profile can be received by the transport path, to a transfer position, whereat the profile can be transferred from the transport path to another processing station, and further to the extrusion position again.

By the use of multiple transport paths carried by a rotatable drum, the horizontal space occupied by the installation may be reduced, while at the same time the installation can be operated in a nearly continuous manner at high speed.

The invention relates also to process for extruding and transporting profiles made of light metal, the profiles being extruded under pressure through a die and transported along a rectilinear transport path with the leading end of the extruded profile being clasped in a pulling means moving along the transport path and keeping the profile under tension.

This process is characterized in that as soon as the profile has the desired length and is completely on the transport path, the leading and trailing ends of the profile are clasped in clamping devices, at least one of which being displacable along the transport path, and in that during a cooling period following the extrusion movement of the at least one clamping device is controlled in a defined way.

Preferably the movement of at least one of the clamping devices is controlled such that after cooling a profile having the desired length is obtained.

In this way subsequent stretching of the profile becomes superfluous.

BRIEF DESCRIPTION OF THE DRAWINGS

Other characteristics and advantages of the invention will become clear from the following description, reference being made to the drawings. In the drawings.

DETAILED DESCRIPTION OF THE INVENTION

Figure 1:
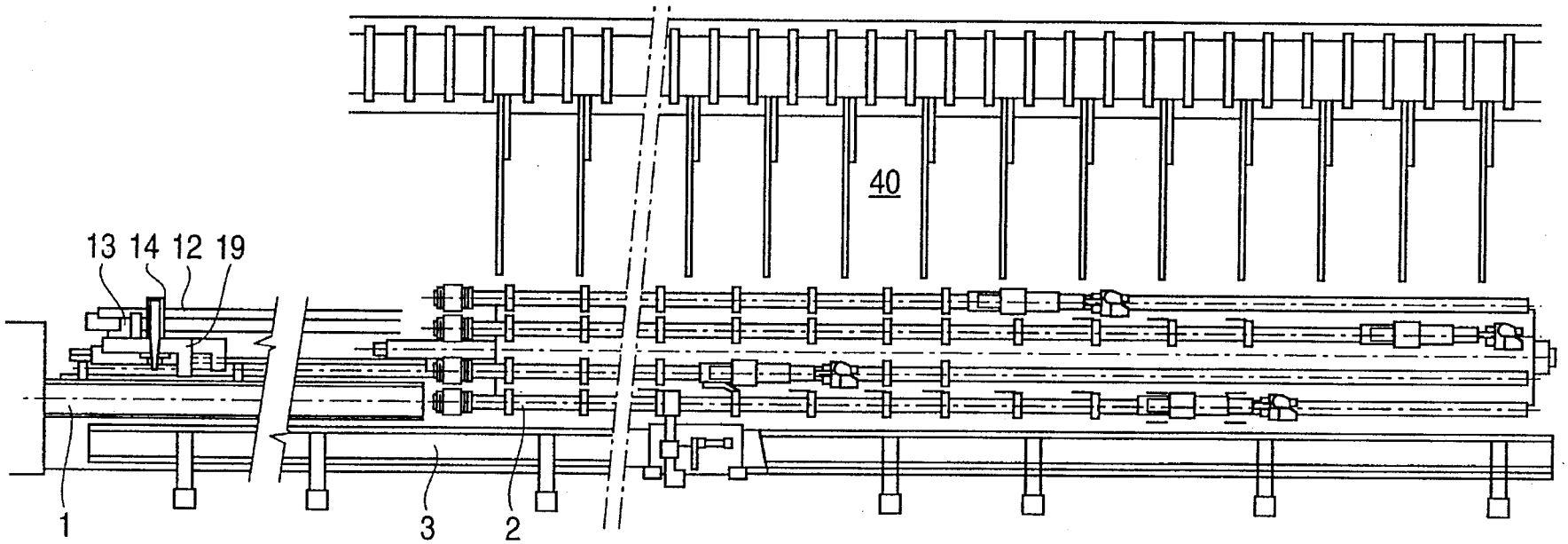
FIG. 1 is a schematic top view of an extrusion installation using the invention.

The installation generally shown in FIG. 1 comprises a first transport path 1, which is positioned behind an extrusion (not shown) which in FIG. 1 is located to the left of the transport path 1. The transport path 1 is of a conventional construction and may comprise a number of rollers, belts or plates spaced regularly along the length of the transport path 1.

The profiles originating from the extrusion unit are transported over the transport path 1 from the left to the right as seen in FIG. 1. Immediately behind the transport path 1 as seen in the direction of movement of the profiles, there is another transport path 2, which is also of a conventional construction with respect to its transport function.

Figure 3:
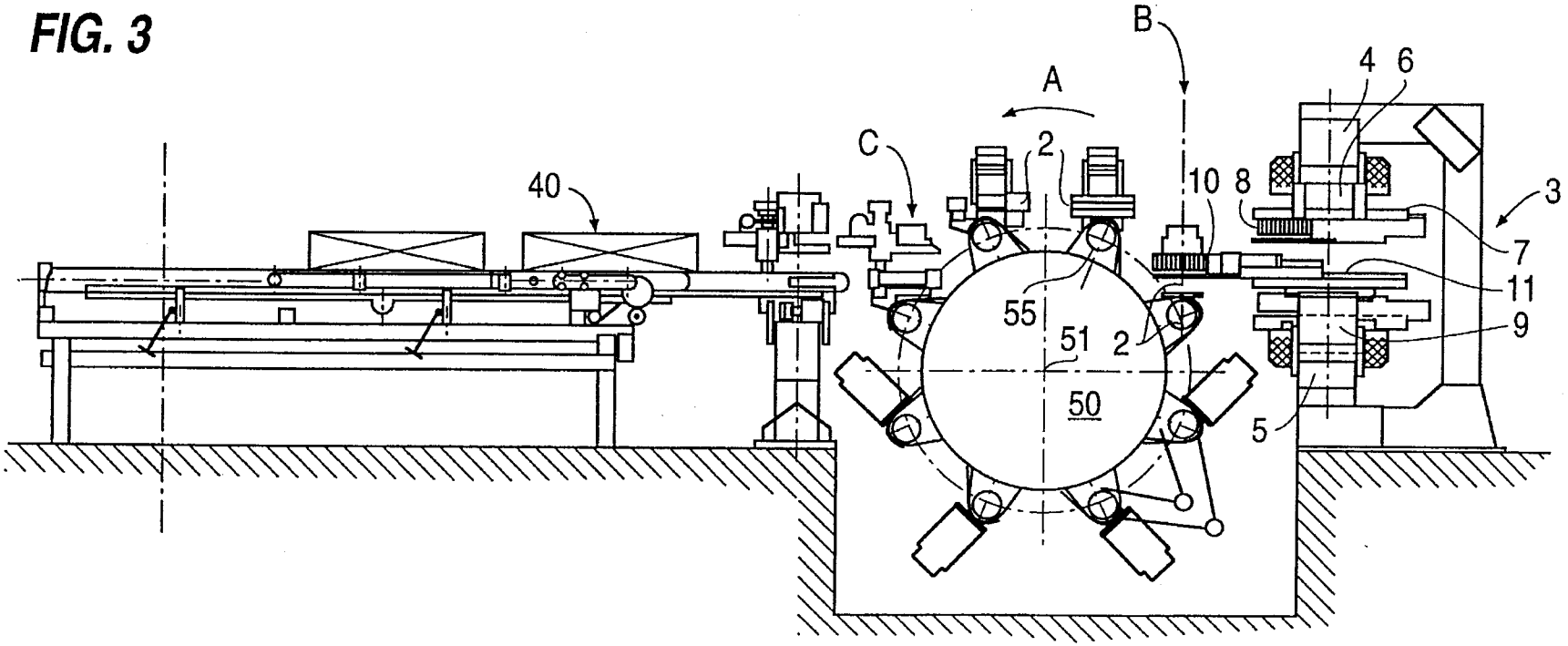
FIG. 3 is a cross section of the installation according FIGS. 1 and 2.

Parallel to the transport paths 1 and 2 and extending along the whole length thereof, there is provided a guiding system 3 which is adapted to guide two carriages independently of each other. The guiding system 3 comprises, as shown in FIG. 3, two tracks, i.e. an upper track 4 and a lower track 5. The upper track 4 carries a carriage 6 movable to and fro along the track 4 by means of an electro-motor. The carriage 6 is provided with a pulling device which is conventional and has a clamp 8 which is adapted to accommodate the leading edge of an extruded profile and to guide it along the transport paths 1 and 2. For that reason the carriage 6 is provided with a kinematic system 7 carrying the clamp 8 for the leading edge of the profile and allowing a sideward and downward movement of the clamp 8. By means of the system 7 it is possible to bring the clamp in the path of movement of the extruded profile, or to have it completely outside that path, thereby allowing the carriage 6 to be moved along the transport paths 1 and 2.

In the same way the lower track 5 carries a carriage 9 movable to and fro along the track 5 by means of an electro-motor carried by it. The carriage 9 is provided with a pulling device which is conventional and has a clamp 10 which is adapted to accommodate the leading edge of an extruded profile and to guide it along the transport paths 1 and 2.

For that reason the carriage 9 is provided with a kinematic system 11 carrying the clamp 10 for the leading edge of the profile and allowing a sideward and upward movement of the extruded profile, or to have it completely outside the path, thereby allowing the carriage 9 to be moved along the transport paths 1 and 2. The design of the kinematic systems 7 and 11 is such that with one pulling device in active position and one pulling device in inactive position the two carriages can move along their respective tracks without interfering with each other. The same applies if both pulling devices are in the inactive position.

Parallel to the transport path 1 and only extending along the whole length thereof, there is provided a track 12 which is adapted to carry a carriage 13. The carriage 13 is provided with a clamp 19 comparable with the clamps 8 and 10, and with a cutting device 14 whereby the extruded profile can be cut to a predetermined length as will be described later. As seen in FIG. 1 the cutting device 14 is located to the left of the clamp 19, i.e. closer to the extrusion unit than the clamp 19. The carriage 13 is movable to and fro along the track 12 by means of an electromotors.

The design of the tracks 4, 5 and 12 and the electro-motors is such that the speed and the position of the different carriages can be accurately controlled.

Figure 2:
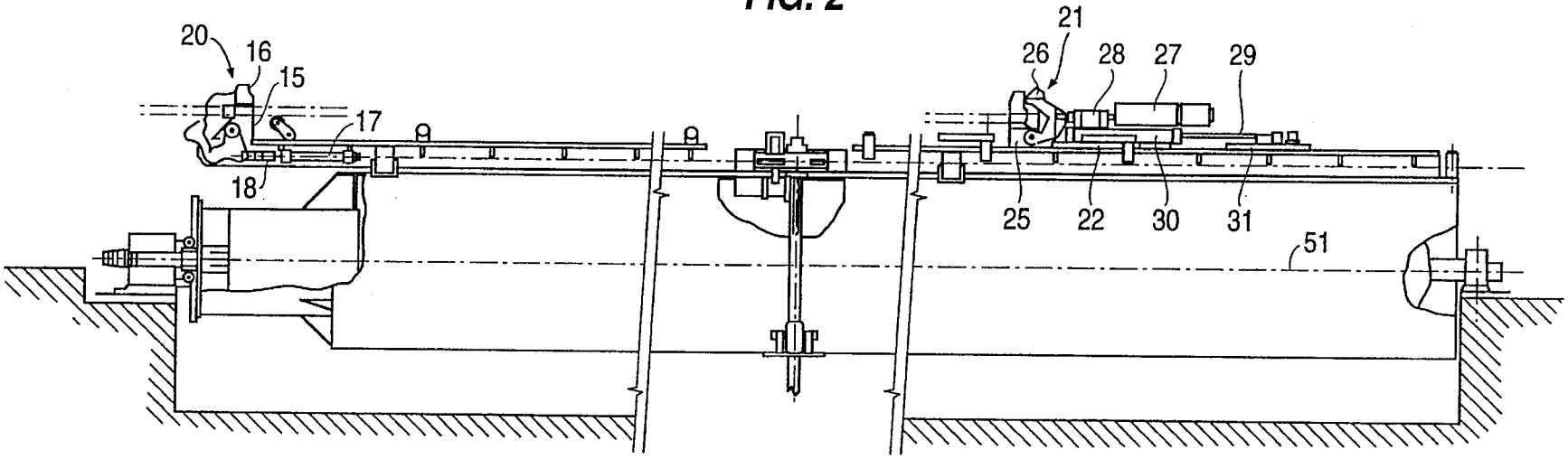
FIG. 2 is a schematic side view of FIG. 1.

As shown in FIG. 2 the transport path 2 is provided with two clamping devices 20 and 21. The clamping device 20 is supported by the transport path 2 near the end, which is located immediately next to the transport path 1. The clamping device 20 comprises a first or lower jaw member 15 having a plane surface lying in line with a supporting surface defined by rollers of the transport path 2. A second or upper jaw member 16 also having a plane surface is rotatably connected with the first jaw member 15 in such a way that it can occupy two end positions, a first end position wherein the two plane surfaces are opposing each other, as shown in FIG. 2, and a second position wherein the second jaw member is positioned below the transport path 2 and makes it possible for an extruded profile to pass the clamping device 20 in order to be conveyed from transport path 1 to transport path 2. In order to move the jaw member 16 from one position to the other position a hydraulic or pneumatic cylinder 17 is mounted under the transport path and includes a piston rod 18 which is connected to the jaw member 16. In this way, by applying pressure to one side of the piston of the cylinder 17 the jaw member 16 can be moved from the second position to the first position, and by applying pressure to the other side of the piston, the jaw member 16 can be moved in an opposite direction.

The clamping device 21 is mounted on a carriage which can be moved along a guidance (not shown in detail) parallel to the transport path 2. The carriage consists in fact of two subcarriages 31 and 22 which are connected to each other in a manner which will be explained here below. Movement of the carriage 31 can be effected by means of an electro-motor driving a gear wheel cooperating with a gear track. By using a step motor the carriage 31 can be positioned and fixed in every position along the transport path 2. The carriage 22 supports the clamping device as such, which clamping device 21 has substantially the same construction as the clamping device 20. The clamping device 21 comprises a first or lower jaw member 25 having a plane surface lying in line with a supporting surface defined by the rollers of the transport path 2. A second or upper jaw member 26 also having a plane surface is rotatably connected with the first jaw member 25 in such a way that it can occupy two end positions, a first end position wherein the two plane surfaces are opposing each other, as shown in FIG. 2, and a second position wherein the plane surface of the second jaw member 26 is positioned some distance above the transport path 2 and away from the plane surface of the first jaw member 25. This makes it possible for the leading end of an extruded profile to pass over the plane surface of the lower jaw member, whereupon the clamping device 21 can be closed. In order to move the jaw member 26 from one position to the other position a hydraulic or pneumatic cylinder 27 is mounted on the carriage and includes a piston rod 28 which is connected to the jaw member 26. In this way, by applying pressure to one side of the piston of the cylinder 27 the jaw member 26 can be moved from the second position to the first position, and by applying pressure to the other side of the piston, the jaw member 26 can be moved in an opposite direction.

Another piston system comprising a cylinder 30 and a piston rod 29 is mounted on the carriage 22. The free end of the piston rod 29 is connected to the carriage 31. In normal conditions this piston system will connect the two carriages in a fixed relationship. By applying pressure to the one or the other side of the piston of cylinder 30 the carriage 22 can be displaced with respect to the carriage 31.

Figure 4:
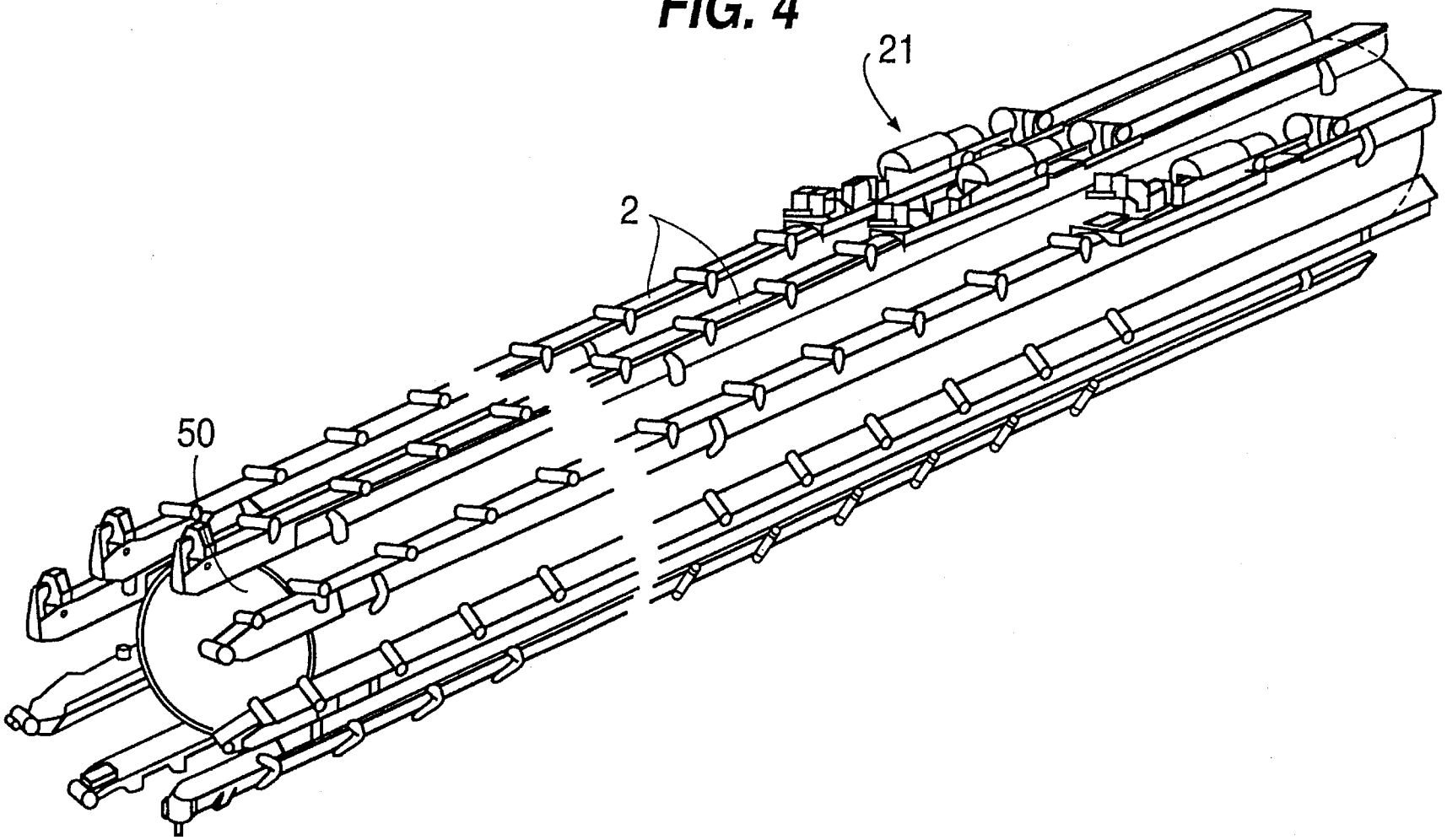
FIG. 4 is a schematic perspective view of a part of the installation according to the invention.

According to the invention and as shown in FIG. 3 and 4 the transport path 2 is mounted on a rotatable support such as drum 50 having a longitudinal axis parallel to the transport path. The drum 50 is mounted for rotation around its longitudinal axis 51, by means not shown, in the direction of arrow A in such a way that the transport path 2 can be moved in a number of steps from a position indicated by B in FIG. 3 to a transfer position indicated by C and further again to the position B. The position indicated by B is a receiving position whereat the transport path 2 is positioned to receive a profile from the transport path 1, whereas the position C is a transfer position wherein the profile can be picked up and further transported by means of a transport system 40.

In fact a number, in the figures eight, of transport paths 2 are mounted on the drum 50 at regularly spaced intervals around the circumference thereof, and the drum 50 is rotated stepwise each time over an angle of 45° in the direction of the arrow A. In this way there is, during standstill of the drum 50, always one transport path in the receiving position B and always one transport path in the transfer position C.

Each of transport paths 2 is mounted in a hingable manner to the circumference of the drum 50, i.e. rotatably around a respective hollow shaft 55 extending parallel to the longitudinal axis of the drum 50 and located somewhat outside the circumference thereof. The rotation of each transport path around the respective shaft 55 is controlled by means of a mechanism (not shown), e.g. a cam-like mechanism or a controlled chain drive, whereby the transport path 2 is rotated around its shaft 55 while the drum 50 is rotating around its axis 51. Each rotation of the transport path 2 around its shaft 55 is controlled in such a way that during the movement from the position B to the position C the transport path is rotated in a clockwise direction about its shaft 55 as seen in FIG. 3 in such a way that the supporting surface for the profile of transport path 2 remains always substantially horizontal during that part of its movement. During the movement of the transport path 2 from the position C to the position B the transport path 2 is rotated in counterclockwise direction around its shaft 55 as seen in FIG. 3, so that in fact the transport path is completely turned around to the position shown as B in FIG. 3.

The interior of each hollow shaft 55 is connected to a source of pressurized cooling air, whereas a number of apertures is provided in the circumference of the shaft 55, which apertures are all located on one line opposite the plane of transport of the profile. In this way it is possible to have the profiles additionally cooled during the transfer of the transport path from the receiving position to the transfer position.

In order to have a controlled cooling along the length of the profile or the transport path 2, it is possible to divide the hollow shaft into a number of length sections. Each length section can have its own supply of pressurized cooling air, and by controlling the supply of air the cooling can be controlled. Such length sections can be provided with respective optical thermometers which are coupled to a control system to make it possible to adjust the cooling power in each section in such a way that a uniform temperature along the length of the profile is obtained, thereby avoiding local distortion or excess tensions.

As an alternative, it is possible to have adjustable shutters on the apertures in such a way that all apertures pertaining to the same length section are commonly controlled so that the cooling power of this section is controlled with adjusting the shutters thereof.

The operation of the device will now be described by reference to FIG. 5.

To completely understand the advantages of the invention it is important to know that the possible length of an extruded profile normally corresponds to one billet. This means that the material consumption of one possible full length extrusion is about equal to the amount of material contained in one billet and that the available length for extrusion at least corresponds to such an extruded length. Upon changing the billet, the extrusion will normally stop, and as the new billet is becoming extruded, the leading end of the then formed profile will be welded to the tailing end of the previous profile, thereby forming a so called welding die mark. This part of the extrusion is of inferior quality and must be removed from the profile upon cutting the extruded lengths to the desired lengths.

Figure 5:
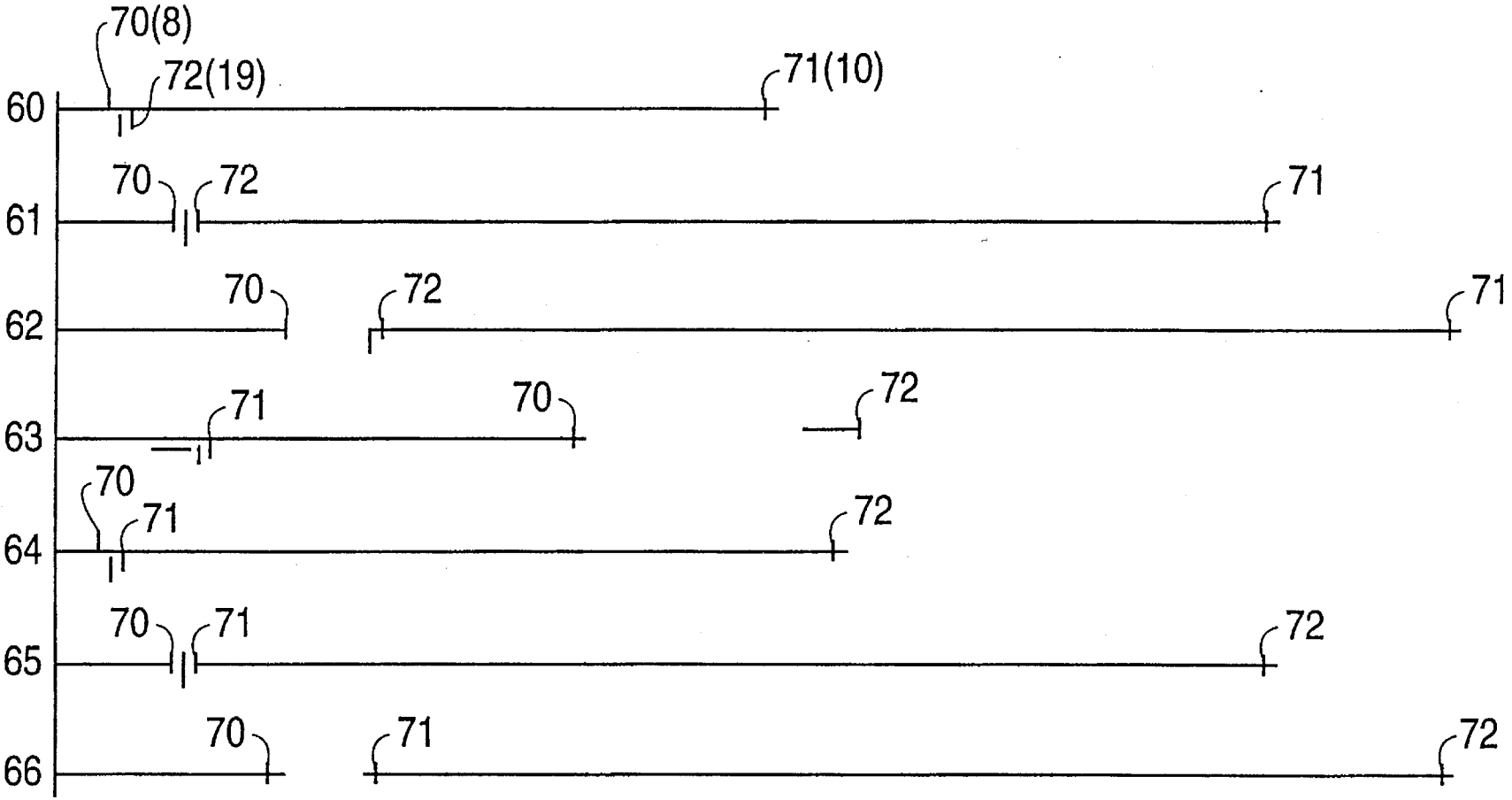
FIG. 5 is a diagram of the different phases of operation of the installation.

Assuming that extrusion is being conducted, the situation indicated by line 60 FIG. 5 is generated, which must be understood as follows. The solid black lines provide an indication of the extruded length of the profile at each stage, each horizontal line presenting a different stage. The reference numbers 70, 71 and 72 respectively indicate the relative position of the clamps 8, 10 and 19.

As shown in FIG. 5, line 60, the clamp 10 is clasping the leading end of the extruded profile and is guiding it along the transport paths 1 and 2. Clamps 8 and 19 are positioned close to the extrusion unit along transport path 1, clamp 8 being closer to the extrusion unit than clamp 19, but both clamps are in their inactive position.

At the moment that a welding die mark is coming out of the extrusion head the clamps 8 and 19 are set in motion in such a way that their relative position is maintained, and that at the moment that they are moving at the same speed as the extruded profile the clamp 19 is somewhat ahead of the welding die mark and the clamp 8 is somewhat behind the welding die mark. The clamps 8 and 19 are then activated. While the clamp 19 is moving at the same speed as the extruded profile, the cutting device is operated whereby the extruded profile is cut very close to the position of the welding die mark (line 61 in FIG. 5). This cutting is thus done while the two ends arising from this cutting are fixed by the clamps, thus avoiding distortions. As the end positions of the full length extruded profiles must be removed later, no additional loss will occur in the removal of the welding die mark. Moreover as the cutting is done while the profile is moving no production speed is lost.

As soon as the cutting operation has been ended the clamps 10 and 19 are moved with a greater linear velocity than the clamp 8, whereby the leading profile is somewhat separated from the trailing profile. This is represented by 62 in FIG. 5.

The leading profile is further transported on a transport path 2. During this further transport the leading and trailing end of the leading profile are clasped by the clamp 10 and 19 respectively.

As the length of the profile is known by calculation, the distance between the clamping devices 20 and 21 on this transport path are, if needed, adjusted to that length before entering the receiving position. As soon as the leading profile is completely on the transport path 2, the leading end thereof is clasped by clamping device 21, while at the same time the clasping action of clamp 10 is stopped. Simultaneously the trailing end of the leading profile is clasped by clamping device 20, while at the same time the clasping action of the clamp 19 is released.

By rotation of the drum the extruded profile is removed from the extrusion line, and a new transport path 2 is brought into the receiving position. At the same time the clamps 10 and 19 are moving (at high speed) in the direction of the extrusion unit, while the extrusion of the trailing profile, now the leading profile, is prosecuted. This is represented by line 63.

In the next phase, line 64, shown by the clamps 10 and 19 are in position close to the extrusion unit, while clamp 8 is guiding the extruded profile. This corresponds with the situation of line 60, except that the clamps 8 and 10 have exchanged their position. The same sequence is now repeated wherein clamps 10 and 8 respectively are acting now as clamps 8 and 10 respectively during the previous sequence, as represented by lines 65, 66 etc. . . In this way the situation corresponding the line 60 will arise again.

During the extrusion of subsequent profiles, the already completely extruded profiles are further handled and treated on their transport path during the rotation of the drum. As already discussed the profile on a transport path is normally clamped by the clamping devices 20 and 21 acting upon the trailing and leading end respectively. In case of a drum with eight transport paths, the drum is rotated over 45° each time, and as soon as the transport path has left the receiving position, the cooling and stretching operation begins.

The temperature of the different length sections of the profile is measured and the cooling is controlled in such a way that a temperature uniform over the length of the profile is obtained. Simultaneously the position of the clamping device 21 with respect to clamping device 20 is regulated in such a way that the desired stretching is obtained. As the clamping device 21 is movable this stretching can be accurately controlled. Thus it is possible to use the contraction force of the cooling as prestretching force, but also to increase or decrease that force.

This process can be prosecuted during the following rotation over 45° of the drum, until the transport path arrives in the transfer position.

From this position the profile is transferred to a further treatment or handling station, such as a stretching station, cutting station, etc. After the profile has been removed from the transport path in the transfer position, the same is rotated through further steps until it comes again to the receiving position.

A special procedure occurs if in the meantime the extrusion die has been changed. In that case, mostly the set length or distance between the two clamping devices must be readjusted, in order to comply with the new profile. This can be done automatically during the period that the transport path is moving from the transfer position to the receiving position.

It will be clear that the invention is not restricted to the embodiment shown but that it is possible to modify the construction of the installation and the process in many way without departing from the scope of the invention. Especially it is possible to modify the number of transport paths mounted on the drum, and to change the cooling cycle.

I claim:

1. An apparatus for extruding and transporting extruded profiles, said apparatus comprising:

an extruder for extruding profiles;

a support having a longitudinal center axis;

at least two longitudinal transport paths mounted on said support and extending parallel to said axis;

said support being rotatable about said axis to successively move each said transport path from an extrusion position, whereat a respective extruded profile can be supplied from said extruder to said each transport path, to a transfer position, whereat the respective extruded profile can be transferred from said each transport path to another processing station, and from said transfer position back to said extrusion position; and each said transport path having first and second clamping devices operable to clasp leading and trailing ends, respectively, of an extruded profile supplied to said each transport path at said extrusion position and to maintain such clasped condition during movement of said each transport path from said extrusion position to said transfer position.

2. An apparatus as claimed in claim 1, wherein a spacing between said first and second clamping devices of each said transport path is adjustable during said movement from said extrusion position to said transfer position.

3. An apparatus as claimed in claim 1, wherein a spacing between said first and second clamping devices of each said transport path is adjustable during movement thereof from said transfer position to said extrusion position.

4. An apparatus as claimed in claim 1, wherein each said transport path has extending along the length thereof cooling means.

5. An apparatus as claimed in claim 4, wherein each said transport path comprises a plurality of longitudinally aligned length sections, and cooling by said cooling means at each said length section is controllable independently of other said length sections.

6. An apparatus as claimed in claim 5, further comprising temperature measuring means for measuring the temperature of the respective extruded profile at each said length section of said transport path, and means to regulate cooling by said cooling means at each said length section as a function of temperature measured thereat.

7. An apparatus as claimed in claim 1, wherein each said transport path is immovable relative to said support in a direction longitudinally thereof.

8. An apparatus as claimed in claim 1, wherein said support comprises a drum-shaped member.

9. An apparatus as claimed in claim 8, wherein said transport paths are mounted adjacent a periphery of said drum-shaped member.

10. An apparatus as claimed in claim 9, wherein each said transport path is mounted for rotation relative to said drum-shaped member about a respective axis defined by a shaft extending parallel to said longitudinal center axis.

11. A process for extruding and transporting profiles, said process comprising:

extruding a profile under pressure through a die;

supplying said profile to a longitudinal transport path at an extrusion position on a support;

clasping leading and trailing ends of said profile by respective first and second clamping devices at said transport path;

rotating said support about a longitudinal center axis thereof extending parallel to said transport path, and thereby moving said transport path and said profile clasped by said clamping devices from said extrusion position to a transfer position; and at said transfer position, releasing said profile from said clamping devices and transferring said profile to another processing station.

12. A process as claimed in claim 11, further comprising additionally rotating said support about said axis and thereby returning said transport path from said transfer position to said extrusion position.

13. A process as claimed in claim 12, further comprising adjusting a spacing between said first and second clamping devices during movement from said extrusion position to said transfer position.

14. A process as claimed in claim 12, further comprising adjusting a spacing between said first and second clamping devices during movement from said transfer position to said extrusion position.

15. A process as claimed in claim 11, comprising providing plural transport paths on said support, and wherein said rotating successively moves each said transport path from said extrusion position to said transfer position and then returns said each transport path from said transfer position to said extrusion position.

16. A process as claimed in claim 11, comprising cooling said profile during movement from said extrusion position to said transfer position.

17. A process as claimed in claim 16, comprising controlling a spacing between said first and second clamping devices as a function of said cooling.

18. A process as claimed in claim 17, comprising controlling said spacing to ensure that said profile when cooled is of a desired length.

19. A process as claimed in claim 18, comprising controlling said spacing during said cooling to maintain said profile under a constant tension force and then increasing said tension force.

* * * * *

UNITED STATES PATENT AND TRADEMARK OFFICE

CERTIFICATE OF CORRECTION

PATENT NO. : 5,560,240

DATED : October 1, 1996

INVENTOR(S) : KARL FÖRSTER and BRUNO MANCINI

It is certified that error appears in the above-identified patent and that said Letters Patent is hereby corrected as shown below:

On the cover page, section "[30] Foreign Application Priority Data", change "1995" to --1994--.

Signed and Sealed this

Second Day of June, 1998

*Attest:*

*Attesting Officer*

Bruce Lehman

BRUCE LEHMAN

*Commissioner of Patents and Trademarks*